US011066793B2

(12) United States Patent
Wang et al.

(10) Patent No.: US 11,066,793 B2
(45) Date of Patent: Jul. 20, 2021

(54) ARCH FOOT MAINTAINING DEVICE AND MAINTENANCE METHOD FOR ACHIEVING MULTI-DEGREE-OF-FREEDOM DISPLACEMENT OF ARCH FOOT

(71) Applicant: CHANGSHA UNIVERSITY OF SCIENCE & TECHNOLOGY, Hunan (CN)

(72) Inventors: Lei Wang, Hunan (CN); Yafei Ma, Hunan (CN); Zhongzhao Guo, Hunan (CN); Jianren Zhang, Hunan (CN)

(73) Assignee: CHANGSHA UNIVERSITY OF SCIENCE & TECHNOLOGY, Hunan (CN)

( * ) Notice: Subject to any disclaimer, the term of this patent is extended or adjusted under 35 U.S.C. 154(b) by 23 days.

(21) Appl. No.: 16/639,745

(22) PCT Filed: Apr. 8, 2019

(86) PCT No.: PCT/CN2019/081664

§ 371 (c)(1),
(2) Date: Feb. 18, 2020

(87) PCT Pub. No.: WO2020/052229

PCT Pub. Date: Mar. 19, 2020

(65) Prior Publication Data

US 2021/0062441 A1 Mar. 4, 2021

(30) Foreign Application Priority Data

Sep. 10, 2018 (CN) ..... 201811047866.2

(51) Int. Cl.

| | |
|---|---|
| ***E01D 4/00*** | (2006.01) |
| ***E01D 22/00*** | (2006.01) |
| ***E01D 19/04*** | (2006.01) |

(52) U.S. Cl.
CPC ..... *E01D 22/00* (2013.01); *E01D 4/00* (2013.01); *E01D 19/042* (2013.01)

(58) Field of Classification Search
CPC ..... E01D 4/00; E01D 19/042; E01D 22/00
(Continued)

(56) References Cited

U.S. PATENT DOCUMENTS 776,252 A * 11/1904 Moller ..... E04B 1/0007 14/24
886,666 A * 5/1908 Thomas ..... E04B 7/08 14/26

(Continued)

FOREIGN PATENT DOCUMENTS

CN 108342992 7/2018
CN 207578243 7/2018

(Continued)

OTHER PUBLICATIONS

"International Search Report (Form PCT/ISA/210) of PCT/CN2019/081664," dated Jul. 9, 2019, pp. 1-5.

*Primary Examiner* — Raymond W Addie
(74) *Attorney, Agent, or Firm* — JCIP Global Inc.

(57) ABSTRACT

An arch foot maintaining device includes a plurality of supporting structures, and the supporting structure includes a base, two base supporting seats, a hydraulic jack, a roller, and a roller supporting seat. The base is a cuboid with equal length and width, a through hole running through side surfaces of the base is provided on the base. A vertical guide groove is provided on each of the two base supporting seats. The roller supporting seat is U-shaped and located between the two base supporting seats, and the roller is rotatably supported in the roller supporting seat. Two ends of a central axis of the roller are respectively located in the two guide grooves, the hydraulic jack is disposed within the base, and (Continued)

a top of the hydraulic jack abuts against a bottom of the roller supporting seat.

10 Claims, 10 Drawing Sheets

(58) Field of Classification Search
USPC ..... 14/2, 24, 26
See application file for complete search history.

(56) References Cited

U.S. PATENT DOCUMENTS 3,296,638 A * 1/1967 Morlon ..... E01D 19/042 14/73.5
3,325,842 A * 6/1967 Spencer ..... E01D 19/04 14/73.5
3,374,497 A * 3/1968 Meheen ..... E01D 21/06 14/26
3,979,787 A * 9/1976 Ahlgren ..... E01D 19/02 14/75
4,320,548 A * 3/1982 Tada ..... E01D 21/065 14/73.5
4,738,707 A * 4/1988 Dunn ..... C03B 37/08 14/73.5
6,682,259 B1 * 1/2004 Thomas, Sr. ..... E01D 4/00 14/24
6,971,795 B2 * 12/2005 Lee ..... E04H 9/023 14/73.5
8,499,395 B2 * 8/2013 Wallerstrom ..... E01D 19/02 14/73.5
10,174,467 B1 * 1/2019 Li et al. ..... E01D 19/042 14/73.5

FOREIGN PATENT DOCUMENTS

CN 109112976 1/2019
DE 0378986 * 1/1989 ..... E01D 19/04
JP 2005188022 7/2005

* cited by examiner

ARCH FOOT MAINTAINING DEVICE AND MAINTENANCE METHOD FOR ACHIEVING MULTI-DEGREE-OF-FREEDOM DISPLACEMENT OF ARCH FOOT

CROSS-REFERENCE TO RELATED APPLICATION

This application is a 371 of international application of PCT application serial no. PCT/CN2019/081664, filed on Apr. 8, 2019, which claims the priority benefit of China application no. 201811047866.2, filed on Sep. 10, 2018. The entirety of each of the above mentioned patent applications is hereby incorporated by reference herein and made a part of this specification.

BACKGROUND

Technical Field

The invention relates to the technical field of arch foot maintenance, and in particular, to an arch foot maintaining device and a maintenance method for achieving multi-degree-of-freedom displacement of an arch foot.

Description of Related Art

An arch bridge has a long history of construction and beautiful appearances, which is one of significant bridge types in the field of bridges today. Due to frequent geological disasters, arch bridges have different degrees of bridge damage as a result of foundation settlement and deformation. For damaged bridges, continuing operating without maintenance results in a relatively high security risk, but premature demolition and reconstruction cause huge economic losses. Therefore, maintaining and strengthening arch bridges with arch foot displacement have great practical significance. A method for maintaining and strengthening a bridge in past construction generally includes strengthening through outer bonding of a steel plate, strengthening through bonding of carbon fiber, strengthening through outer covering of concrete, and prestressed strengthening. The above strengthening methods help, to some extent, improve resistance of arch bridges, but do not resolve the problem fundamentally. An arch rib is a main load-bearing member of an arch bridge, and is mainly built on a solid rock foundation or a large concrete foundation. Settlement and deformation of the foundation change the overall mechanical property of the arch bridge. However, there is no report about how to maintain and strengthen a displaced arch foot to improve a stress status of an arch bridge, thereby enabling the arch bridge structure to continue serving securely after foundation settlement and deformation.

SUMMARY

For maintenance and strengthening of an arch foot of an existing arch bridge in service, the invention provides a simple, economical, and practical arch foot maintaining device and a maintenance method for achieving multi-degree-of-freedom displacement of an arch foot. The technical solutions are as follows.

An arch foot maintaining device includes a plurality of supporting structures combined along a straight line. The supporting structure includes a base, two base supporting seats disposed on an upper surface of the base, a hydraulic jack, a roller, and a roller supporting seat. The base is a cuboid with equal length and width, and a through hole running through four side surfaces of the base is provided on the base. A vertical guide groove is provided on each of the two base supporting seats. The roller supporting seat is U-shaped and located between the two base supporting seats. The roller is rotatably supported in the roller supporting seat, and two ends of a central axis of the roller are located in the two guide grooves, respectively. A plane where the roller lies is parallel to the side surface of the base. The hydraulic jack is disposed within the base, and a top of the hydraulic jack abuts against a bottom of the roller supporting seat. The plane where the roller lies is perpendicular to the central axis of the roller.

Further, two sides of the roller each have a shaft, and the shafts are disposed on the roller supporting seat through bearings.

Further, a vertical pin hole is provided on each of four corners of the base. Rectangular connecting holes are provided on side surfaces of the four corners of the base at different heights, and the rectangular connecting hole is in communication with the vertical pin hole. Two adjacent supporting structures are connected through a connecting rod whose both ends are provided with a circular through hole. Two ends of the connecting rod are inserted into the rectangular connecting holes of the two adjacent supporting structures, respectively. A pin in the vertical pin hole passes through the circular through hole of the connecting rod.

Further, the central axes of the rollers of the two adjacent supporting structures are perpendicular to each other.

Based on a same inventive concept, the invention further relates to a maintenance method for achieving multi-degree-of-freedom displacement of an arch foot. The arch foot maintaining device is used in the method, and the method specifically includes following steps.

1) Providing rectangular grooves: providing the rectangular grooves around the arch foot, the rectangular grooves are respectively distributed in at least four section al planes of the arch foot, namely, one plane perpendicular to a longitudinal direction of a bridge (referred to as a back plane), two planes perpendicular to a transverse direction of the bridge (referred to as side planes), and one horizontal plane. The rectangular grooves in the back plane and side planes extend along a vertical direction, and the rectangular groove in the horizontal plane extending along the longitudinal direction of the bridge.

2) Performing plane sectioning: plane sectioning is performed along planes of the rectangular grooves close to the arch foot, and obtaining an arch foot separated body by at least four sectional planes.

3) Placing the arch foot maintaining device: placing one arch foot maintaining device at every one of the rectangular grooves, and reserving one of the rectangular grooves being empty between two adjacent arch foot maintaining devices.

4) Adjusting a roller position of the arch foot maintaining device: the rollers of the arch foot maintaining device are adjusted according to a required arch foot displacement form, so that at least partial rollers of the arch foot maintaining device push against the corresponding sectional plane.

5) Cutting off concrete located in a direction where the arch foot separated body moves, and removing the concrete that is cut off.

6) Adjusting the roller position of the arch foot maintaining device again: the at least partial rollers push the arch foot separated body to move or move with the arch foot separated body.

7) Lowering all the rollers of the arch foot maintaining device after the arch foot separated body is moved in place, and removing the arch foot maintaining device.

8) Pouring concrete around the arch foot separated body.

Further, in the step 7), after the arch foot separated body is moved in place, positioning blocks for positioning the arch foot separated body are placed in at least a portion of the empty rectangular groove.

Further, in the step 4), when the arch foot is adjusted for transverse translation, transverse rollers of the arch foot maintaining devices in the rectangular grooves distributed in the back plane and in the horizontal plane abut against a corresponding sectional plane, and all rollers of the arch foot maintaining devices in the rectangular groove distributed in the side plane push against a corresponding sectional plane.

When the arch foot is adjusted for longitudinal translation, longitudinal rollers of the arch foot maintaining devices in the rectangular grooves distributed in the side planes and in the horizontal plane abut against a corresponding sectional plane, and all rollers of the arch foot maintaining devices in the rectangular groove distributed in the back plane push against a corresponding sectional plane.

When the arch foot needs to be adjusted for vertical translation, vertical rollers of the arch foot maintaining devices in the rectangular grooves distributed in the back plane and in the side planes abut against a corresponding sectional plane, and all rollers of the arch foot maintaining devices in the rectangular groove distributed in the horizontal plane push against a corresponding sectional plane. It should be noted that the transverse roller is a roller that may be rolled along the transverse direction (a plane of the roller is parallel to the transverse direction), the longitudinal roller is a roller that may be rolled along the longitudinal direction (a plane of the roller is parallel to the longitudinal direction), and the vertical roller is a roller that may be rolled along the vertical direction (a plane of the roller is parallel to the vertical direction).

Further, in the step 4), when the arch foot is rotated transversely, vertical rollers of the arch foot maintaining devices in the rectangular groove distributed in the back plane push against a corresponding sectional plane, and longitudinal rollers of the arch foot maintaining devices in the rectangular groove distributed in the horizontal plane push against a corresponding sectional plane.

When the arch foot is rotated longitudinally, vertical rollers of the arch foot maintaining devices in the rectangular groove distributed in the side planes push against a corresponding sectional plane, and transverse rollers of the arch foot maintaining device in the rectangular groove distributed in the horizontal plane push against a corresponding sectional plane.

When the arch foot is rotated vertically, transverse rollers of the arch foot maintaining devices in the rectangular groove distributed in the back plane push against a corresponding sectional plane, and longitudinal rollers of the arch foot maintaining devices in the rectangular groove distributed in the side planes push against a corresponding sectional plane.

Technical effects of the invention are as follows: a plurality of supporting structures are freely combined to form an arch foot maintaining device, which is simple in structure, flexible, convenient in operation, and highly adaptable, facilitating arrangement and storage of the arch foot maintaining device. The arch foot maintenance method where the arch foot maintaining device is used can be employed to achieve multi-degree-of-freedom displacement of the arch foot to adapt to settlement and deformation of a foundation, and may be widely applied in maintenance of an arch foot of an arch bridge in service.

Figure 2:
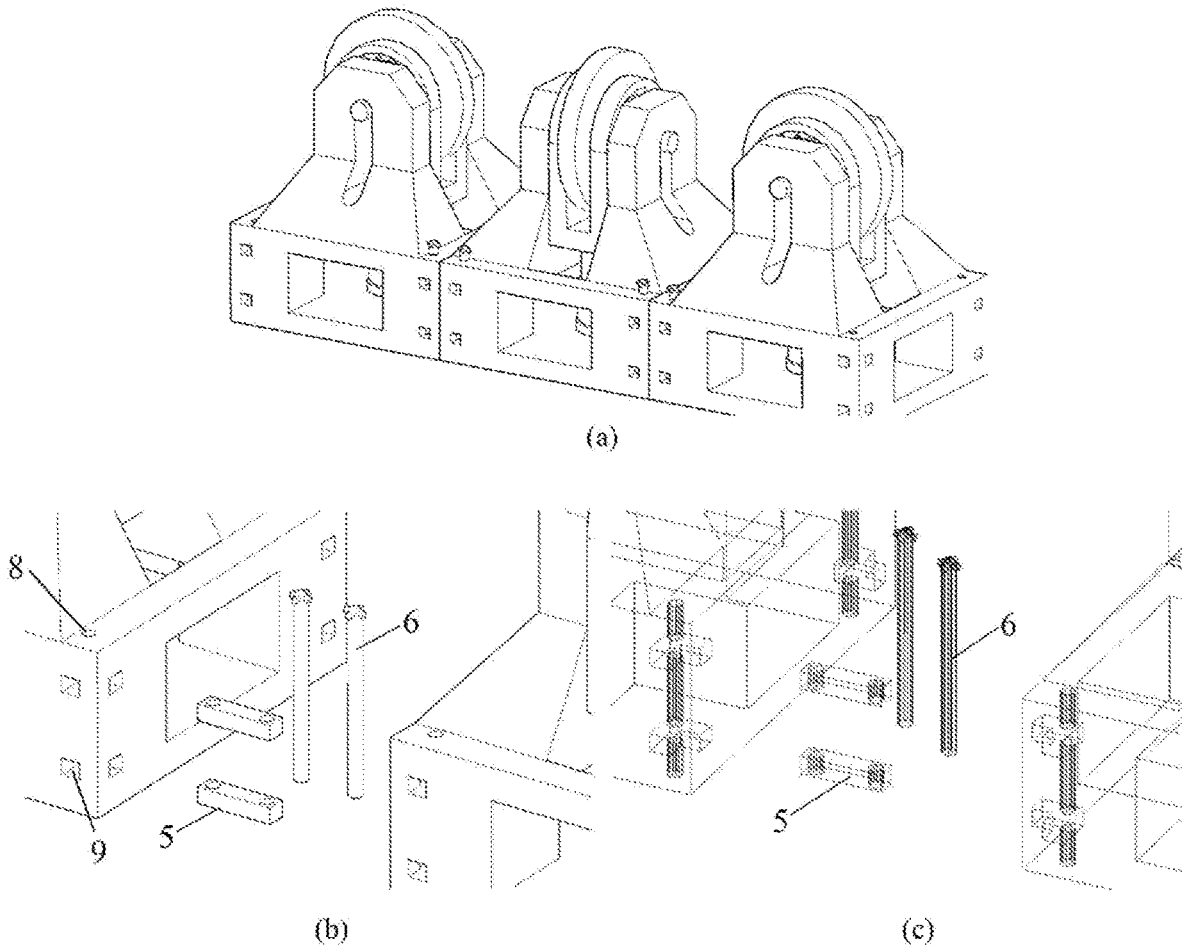

(a) of FIG. 2 is a schematic assembled view of the arch foot maintaining device according to the invention.

(b) of FIG. 2 is a schematic connection view of a supporting structure of the arch foot maintaining device according to the invention.

(c) of FIG. 2 is a perspective connection view of the supporting structure of the arch foot maintaining device according to the invention.

Figure 3:
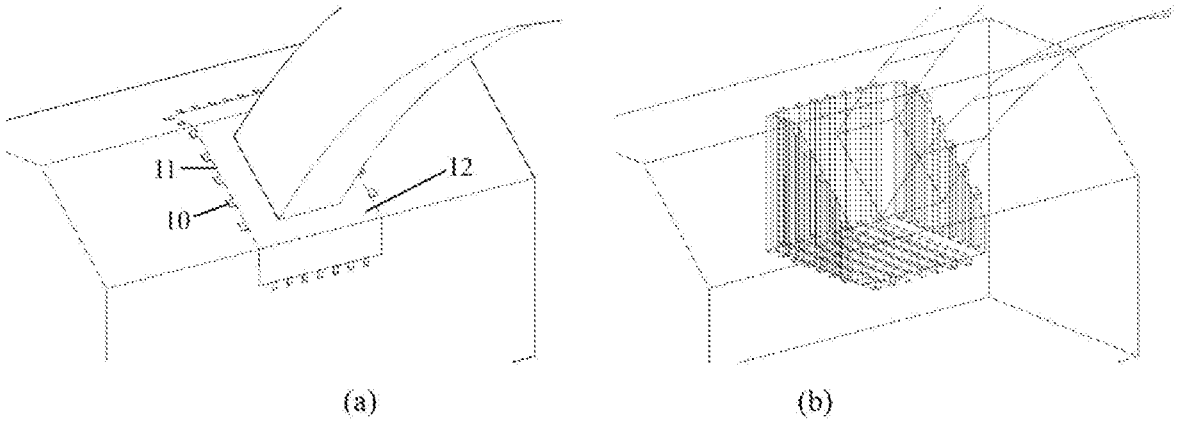

(a) of FIG. 3 is a schematic view of rectangular grooves and a sectional plane provided at an arch foot position.

(b) of FIG. 3 is a perspective view of the rectangular grooves and the sectional plane provided at the arch foot position.

Figure 4:
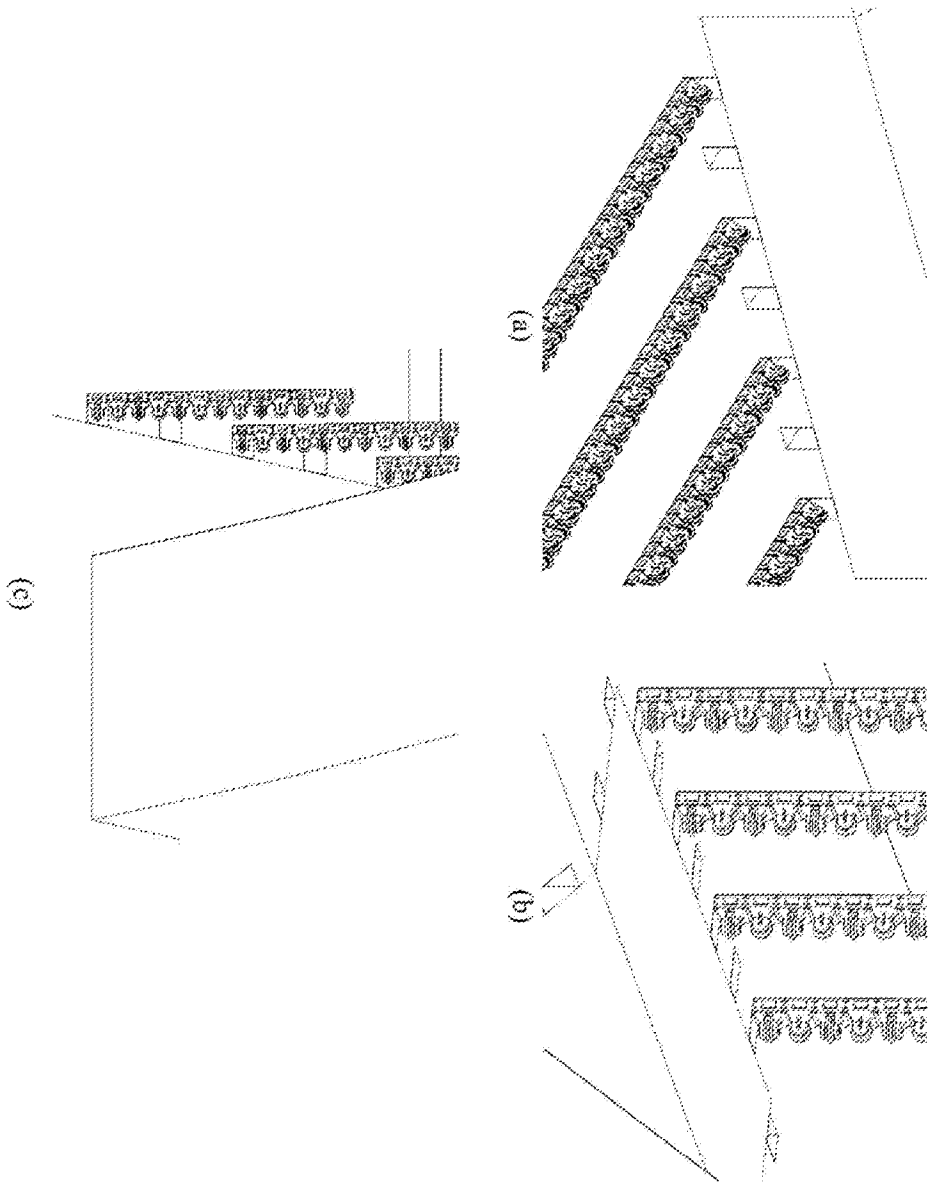

(a) of FIG. 4 is a schematic view of placing an arch foot maintaining device at a bottom of an arch foot.

(b) of FIG. 4 is a schematic view of placing the arch foot maintaining device at a back of the arch foot.

(c) of FIG. 4 is a schematic view of placing the arch foot maintaining device at a side surface of the arch foot.

Figure 5:
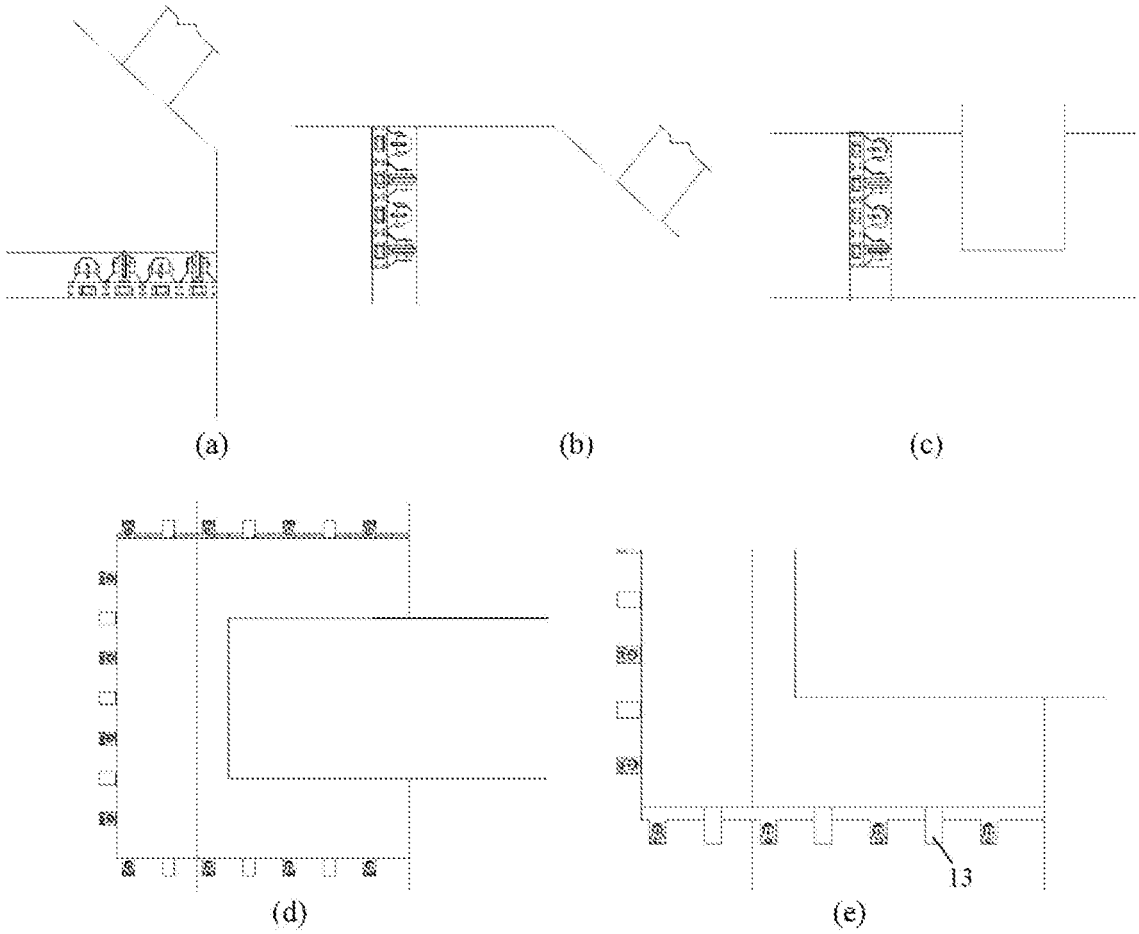

FIG. 5 is a schematic diagram of transverse translation of the arch foot and a schematic operating diagram of a roller of an arch foot maintaining device at each position.

Figure 6:
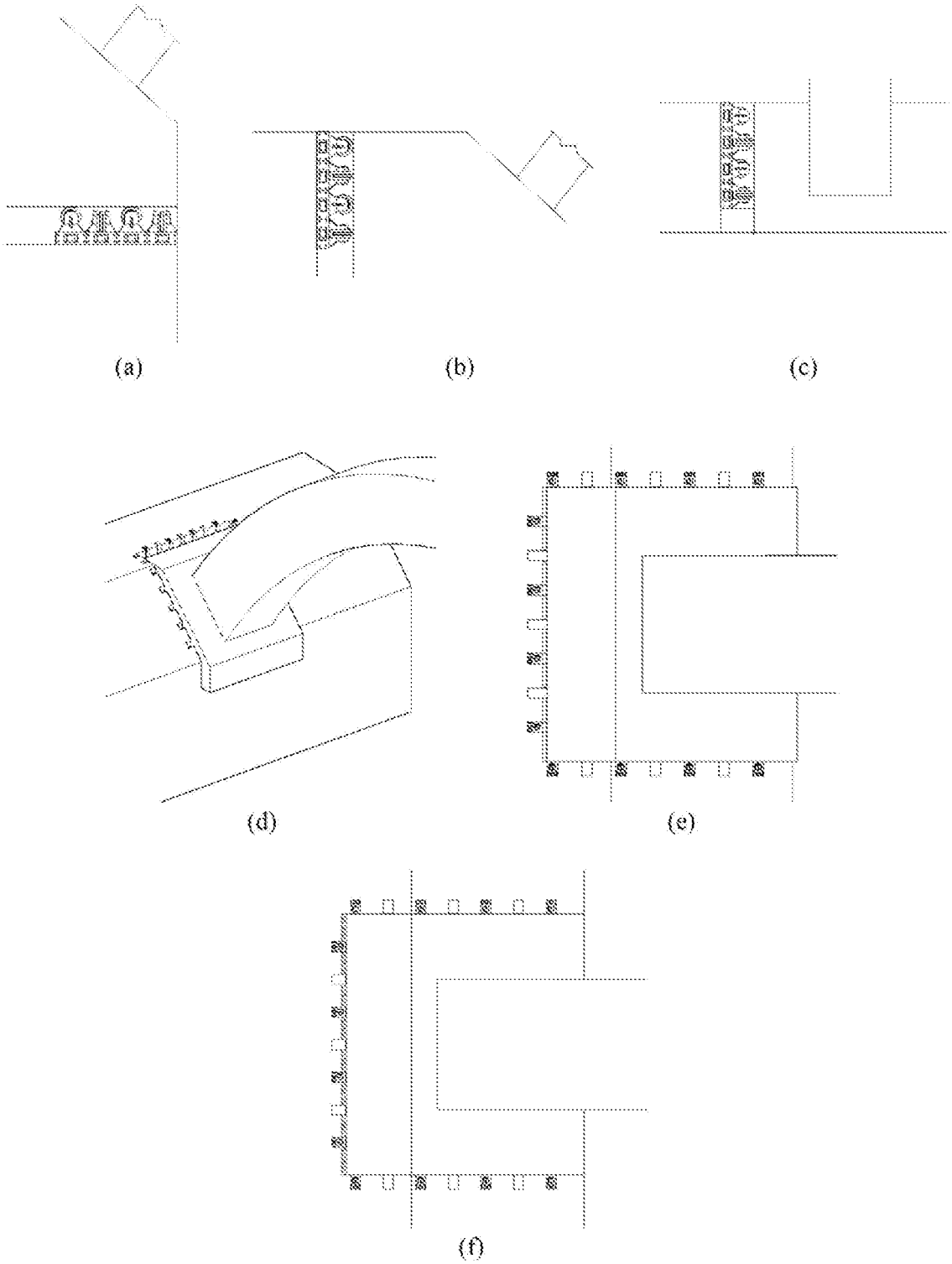

FIG. 6 is a schematic diagram of longitudinal translation of the arch foot and a schematic operating diagram of the roller of an arch foot maintaining device at each position.

Figure 7:
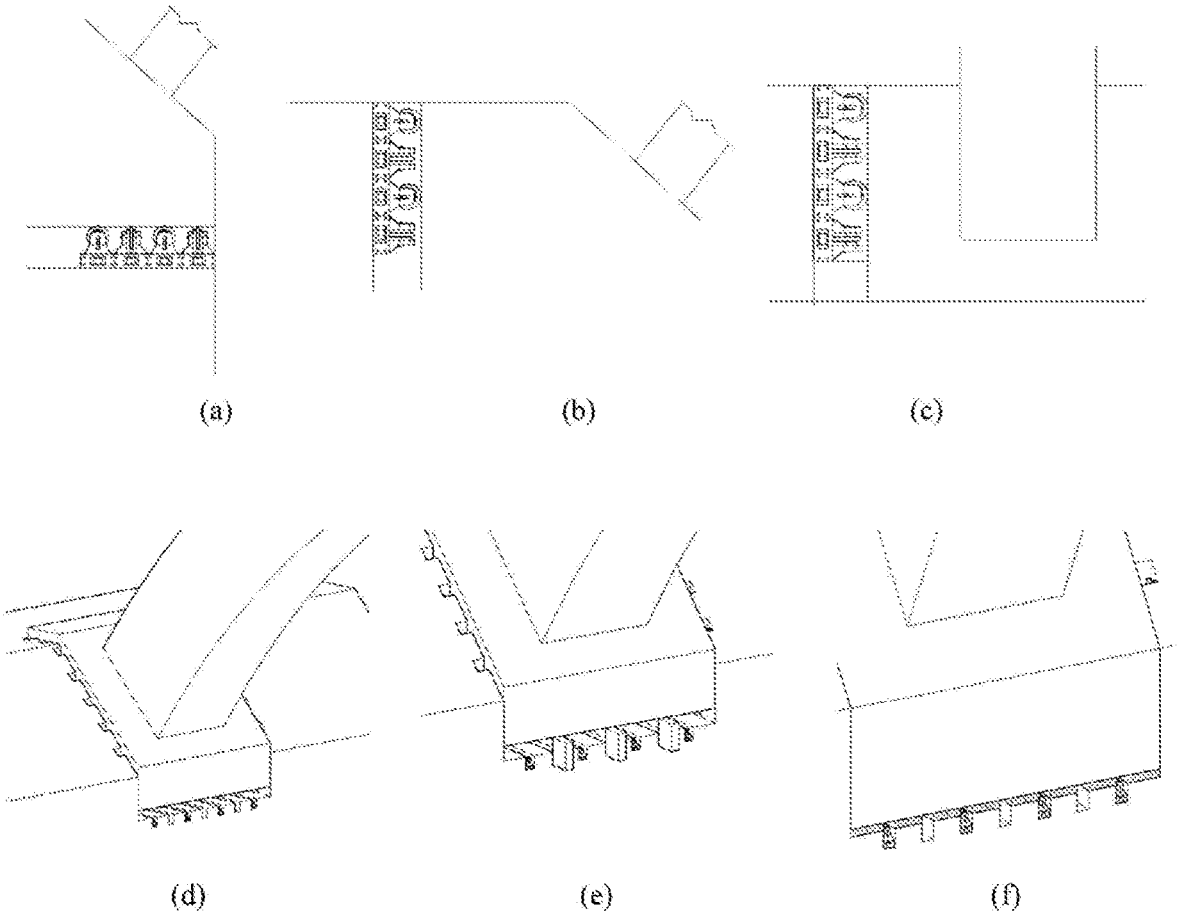

FIG. 7 is a schematic diagram of vertical translation of the arch foot and a schematic operating diagram of the roller of the arch foot maintaining device at each position.

Figure 8:
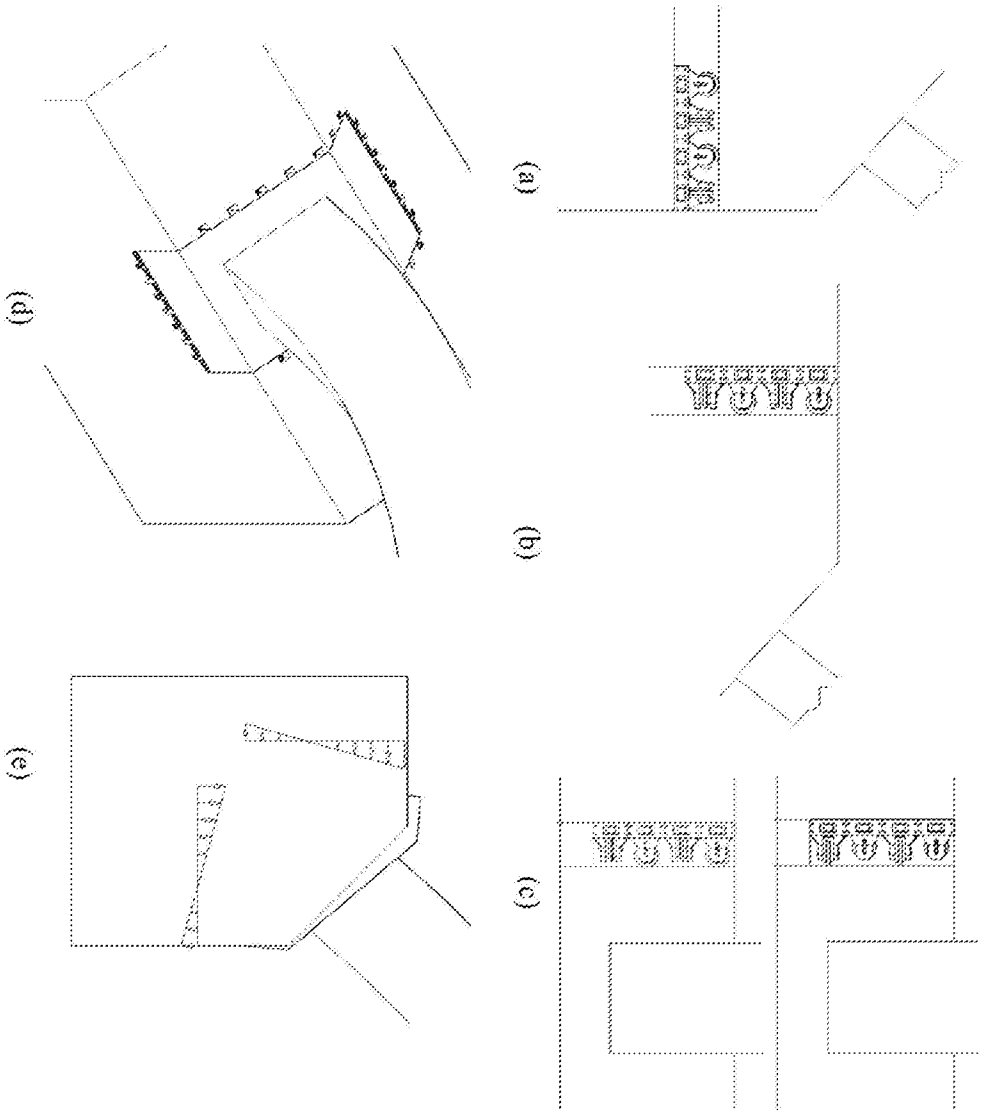

FIG. 8 is a schematic diagram of rotation along a transverse axis of the arch foot and a schematic operating diagram of the roller of the arch foot maintaining device at each position.

Figure 9:
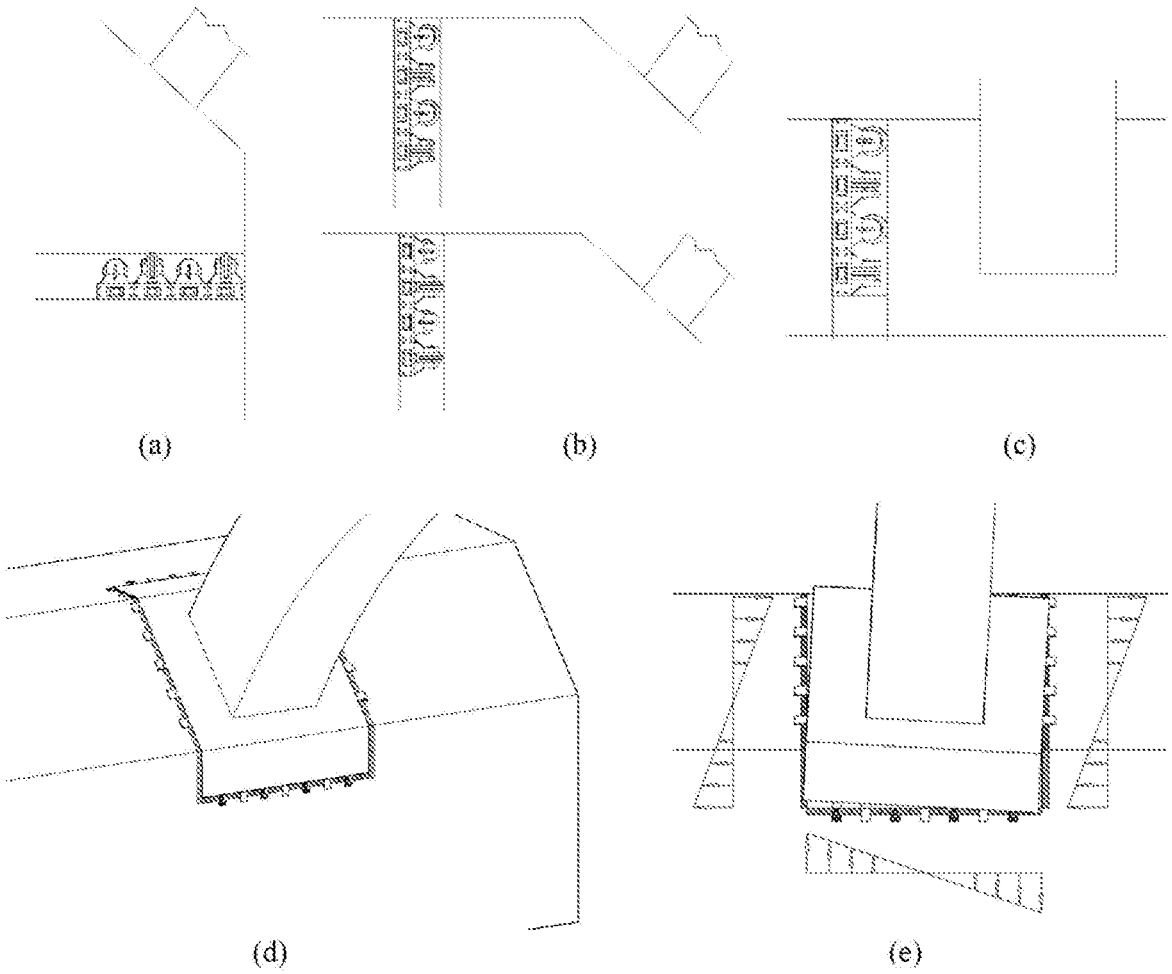

FIG. 9 is a schematic diagram of rotation along a longitudinal axis of the arch foot and a schematic operating diagram of the roller of the arch foot maintaining device at each position.

Figure 10:
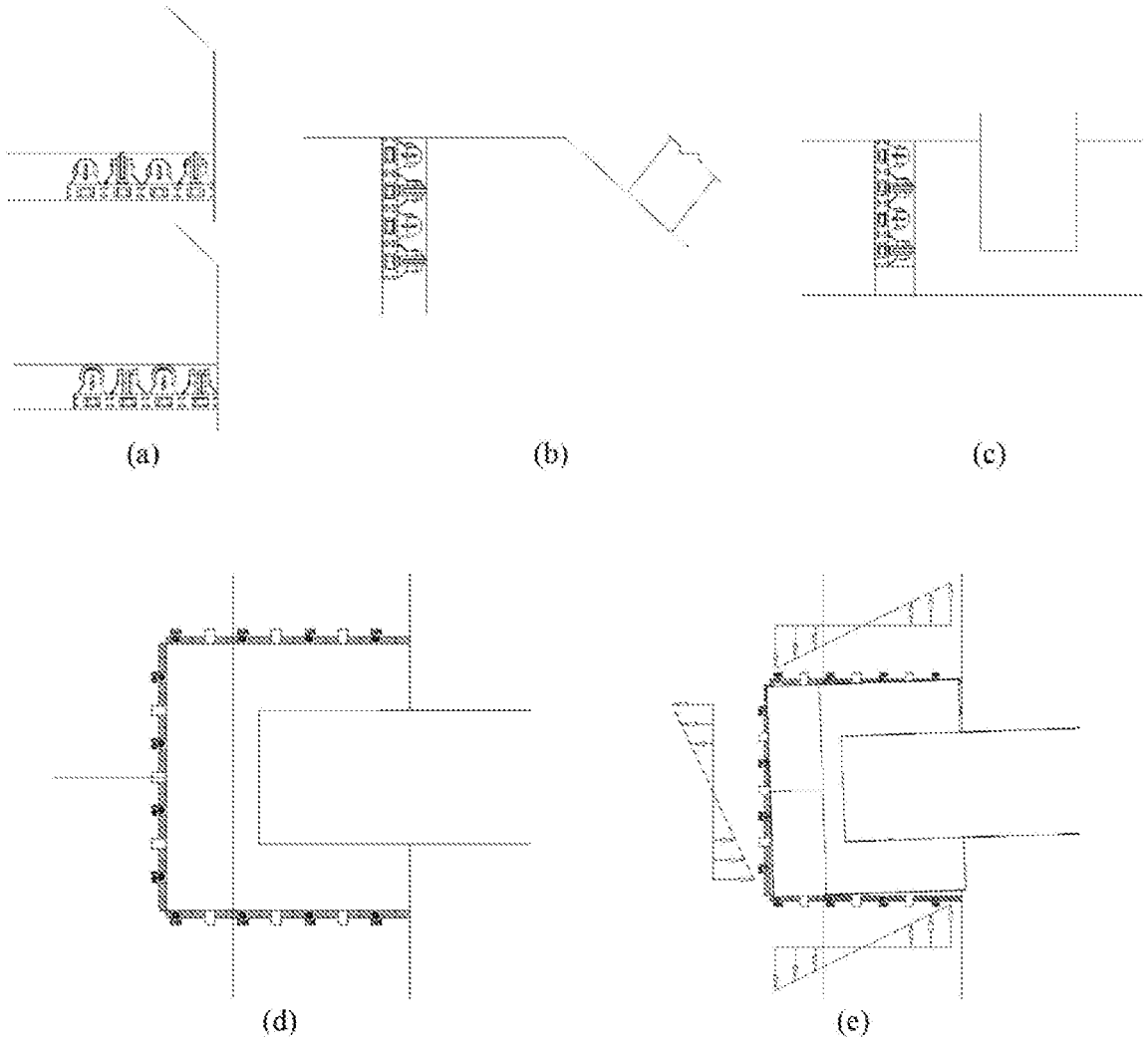

FIG. 10 is a schematic diagram of rotation along a vertical axis of the arch foot and a schematic operating diagram of the roller of the arch foot maintaining device at each position.

DESCRIPTION OF THE EMBODIMENTS

The following further describes the present invention in detail with reference to accompanying drawings.

Figure 1:
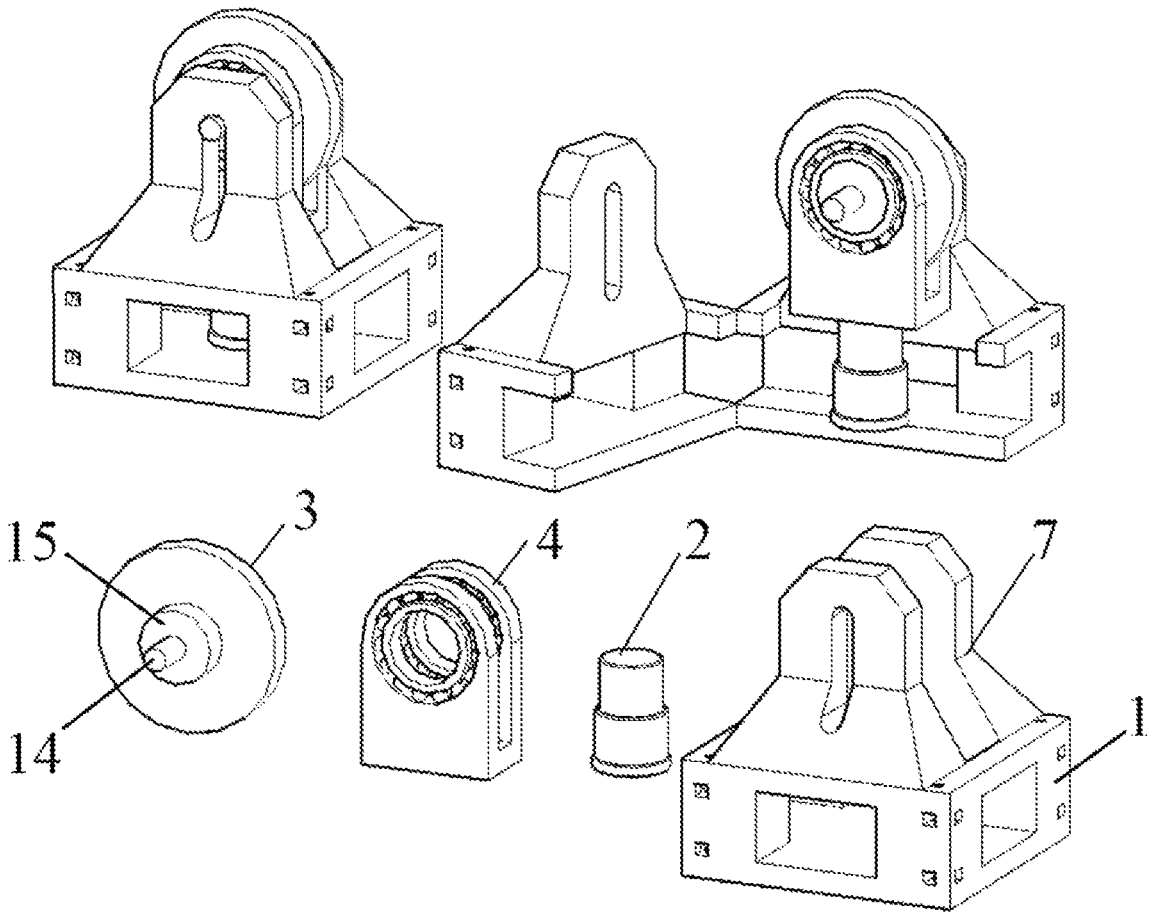
FIG. 1 is an overall schematic view, a cross-sectional view, and an exploded schematic view of a supporting structure of an arch foot maintaining device according to the invention.

Referring to FIG. 1 to FIG. 2, an arch foot maintaining device includes a plurality of supporting structures combined along a straight line. The supporting structure includes a base 1, two base supporting seats 7 disposed on an upper surface of the base 1, a hydraulic jack 2, a roller 3, and a roller supporting seat 4. The base 1 is a cuboid with equal length and width. A through hole running through four side surfaces of the base 1 is provided on the base 1, and the through hole further runs through the upper surface of the base 1. A vertical guide groove is provided on each of the two base supporting seats 7. The roller supporting seat 4 is U-shaped and located between the two base supporting seats 7. The two base supporting seats 7 can guide the roller supporting seat 4 to some extent. The roller 3 is rotatably supported in the roller supporting seat 4. Two ends of a central axis 14 of the roller 3 are located in the two guide grooves, respectively. A plane where the roller 3 lies is parallel to a side surface of the base 1. The hydraulic jack 2 is disposed within the base 1, and a top of the hydraulic jack 2 abuts against the bottom of the roller supporting seat 4, and a bottom of the hydraulic jack 2 is located in the through hole of the base 1. The central axis 14 of the roller can be fixedly or rotationally connected to the roller. The arch foot maintaining device is mainly configured to adjust a position (height) of the roller to support an arch foot. Detailed usage is described below. The through hole of the base 1 is configured to place the hydraulic jack and arrange a hydraulic pipeline of the hydraulic jack. Since the four side surfaces of the base are in communication with the through hole, when a plurality of supporting structures are combined along a straight line, the hydraulic pipeline can always be arranged inside the base 1 of the supporting structure along the straight line, helping protecting the hydraulic pipeline and ensuring the use stability of the hydraulic jack. During use of the arch foot maintaining device, the hydraulic jack 2 of each supporting structure may be controlled to be lifted/lowered according to a specific requirement. When the hydraulic jack 2 is lifted, the roller supporting seat 4 is pushed. The roller supporting seat 4 is guided by the two base supporting seats 7, and the central axis of the roller 3 is guided by the guide groove of the base supporting seat 7, so that the roller supporting seat 4 is steadily lifted, and the roller 3 can rotate relative to the roller supporting seat 4.

Preferably, two sides of the roller 3 each have a shaft 15. The shafts 15 are disposed on the roller supporting seat 4 through bearings. The central axis passes through both the roller and the shaft. The roller 3 is disposed on the roller supporting seat 4 through the bearing, so that rotation resistance on the roller 3 can be reduced. The disposed shaft allows the roller to withstand a relatively large force transmitted by the hydraulic jack.

Further, a vertical pin hole 8 is provided on each of four corners of the base 1. Rectangular connecting holes 9 are provided on side surfaces of the four corners of the base 1 at different heights. The rectangular connecting hole 9 is in communication with the vertical pin hole 8. Two adjacent supporting structures are connected through a connecting rod 5 whose both ends are provided with a circular through hole. Two ends of the connecting rod 5 are inserted into the rectangular connecting holes 9 of the two adjacent supporting structures, respectively. A pin 6 in the vertical pin hole 8 passes through the circular through hole of the connecting rod 5. In the foregoing connecting manner, adjacent supporting structures may be freely combined and connected, which is simple and reliable. In order to ensure that the pin 6 does not fall off during use, an anti-fall hole (not shown) may be provided on the top of the pin, and a safety wire passes through the anti-fall hole to fix the pin 6 to the base 1.

Preferably, the central axes of the rollers 3 of the two adjacent supporting structures are perpendicular to each other. In this way, it can be ensured that rollers of different phases can be evenly distributed, so that the roller of the arch foot maintaining device can slide in different directions, helping moving the arch foot in different directions, thereby achieving multi-degree-of-freedom displacement of the arch foot.

Based on a same inventive concept, the invention further provides to a maintenance method for achieving multi-degree-of-freedom displacement of an arch foot. The arch foot maintaining device is used in the method, and the method specifically includes following steps.

1). A rectangular groove 10 is provided. The rectangular grooves 10 are provided in at least four sectional planes around an arch foot. The rectangular grooves 10 are distributed in a plane (referred as a back plane) perpendicular to a longitudinal direction of a bridge, two planes (referred as side planes) perpendicular to a transverse direction of the bridge, and a horizontal plane. The rectangular grooves in the back plane and in the side planes extend along a vertical direction, and the rectangular grooves in the horizontal plane extend along the longitudinal direction of the bridge.

2). Performing plane sectioning: plane sectioning is performed along the planes of the rectangular grooves 10 close to the arch foot, and at least four sectional planes 11 are necessary to obtain an arch foot separated body 12. FIG. 3 shows four sectional planes 11, which are two side surfaces (plane perpendicular to the transverse direction of the bridge) of an arch foot, one back surface (a plane perpendicular to the longitudinal direction of the bridge) of the arch foot, and one bottom surface (a horizontal plane) of the arch foot. The four planes are connected to each other to cut off the arch foot separated body 12, and the arch foot separated body 12 is separated from a foundation of the bridge. It should be noted that five sectional planes 11 may also be used to form the arch foot separated body 12. Compared to the four sectional planes 11, an arch foot front sectional plane (not shown) parallel to the back plane of the arch foot may be added.

3). The arch foot maintaining device is placed: one arch foot maintaining device is placed at every rectangular groove (10), and one of the rectangular grooves (10) that is empty is reserved between two adjacent arch foot maintaining devices.

4). A roller position of the arch foot maintaining device is adjusted: the rollers 3 of the arch foot maintaining devices are adjusted according to a required arch foot displacement, so that at least partial rollers 3 of the arch foot maintaining device push against the sectional plane 11.

5). Concrete located in a direction where the arch foot separated body moves is cut off, and the concrete that is cut off is removed.

6). The roller position of the arch foot maintaining device is adjusted again: the at least partial rollers 3 push the arch foot separated body 12 to move or move with the arch foot separated body.

7). After the arch foot separated body 12 is moved in place, all rollers 3 of the arch foot maintaining device are lowered, and the arch foot maintaining device is removed.

8). Concrete is poured around the arch foot separated body.

Preferably, in the step 3), one arch foot maintaining device is placed at every rectangular groove 10, and one empty rectangular groove 10 is reserved between two adjacent arch foot maintaining devices.

Preferably, in the step 7), after the arch foot separated body 12 is moved in place, positioning blocks 13 for positioning the arch foot separated body 12 are placed in at least a portion of the empty rectangular groove.

A specific displacement manner of the arch foot is described in detail below.

In actual construction, the arch foot deviates from an original design position due to a foundation settlement and deformation. When the displaced arch foot needs to be adjusted to the original design position, any displacement may include the following six basic displacements: translation along transverse, longitudinal, and vertical directions of a bridge and rotation around transverse, longitudinal, and vertical axes.

The method for maintaining an arch foot of an arch bridge mainly includes the following eight basic steps: providing of a rectangular groove, plane sectioning, placing of the arch foot maintaining device, adjustment of lifting/lowering of the roller of the arch foot maintaining device, placing of a positioning block, lowering of all rollers of the arch foot maintaining device, removal of the arch foot maintaining device, and pouring of concrete. Implementation of the six basic displacements is described below.

Methods for providing the rectangular grooves, sectional planes, and placing the arch foot maintaining device are the same for the six basic displacement cases. As shown in FIG. 3, the rectangular groove is provided and plane sectioning is performed to obtain the arch foot separated body 12, and the sectional plane overlaps a plane of the rectangular groove close to the arch foot. In this sectioning manner, on the one hand, the rectangular groove 10 is provided to facilitate plane sectioning, and on the other hand, when a portion of the concrete needs to be removed during subsequent removal of the arch foot separate body 12, the concrete may be removed through the rectangular groove 10, helping improving construction efficiency. The method for placing the arch foot maintaining device is shown in FIG. 4. The arch foot maintaining device is placed in a rectangular groove 10 at intervals, and an empty rectangular groove 10 is reserved between two adjacent arch foot maintaining devices. (Note: In the invention, the transverse, longitudinal, and vertical directions of the bridge are used to represent a direction). Because any two non-parallel directions can form a plane, planes in the following description are collectively expressed in transverse, longitudinal, and vertical directions, that is, the bottom surface (a horizontal plane) of the arch foot has only transverse and longitudinal rollers, the back surface (the plane perpendicular to the longitudinal direction of the bridge) of the arch foot has only transverse and vertical rollers, and the side surface (the plane perpendicular to the transverse direction of the bridge) of the arch foot has only vertical and longitudinal rollers. The transverse roller may be a roller that may be rolled along the transverse direction (a plane of the roller is parallel to the transverse direction), the longitudinal roller may be a roller that may be rolled along the longitudinal direction (a plane of the roller is parallel to the longitudinal direction), and the vertical roller is a roller that may be rolled along the vertical direction (a plane of the roller is parallel to the vertical direction).

(1) Transverse Translation

After completion of providing the rectangular groove, plane sectioning, and placing the arch foot maintaining device, first, all transverse rollers ((a) of FIG. 5) of an arch foot maintaining device at the bottom of the arch foot, all transverse rollers ((b) of FIG. 5) of an arch foot maintaining device at the back of the arch foot, and all rollers ((c) of FIG. 5) of arch foot maintaining devices at two side surfaces of the arch foot are lifted to hold the arch foot separated body. Next, in a direction of transverse translation, plane sectioning ((d) of FIG. 5) is performed on concrete on the side surface of the arch foot, and a sectioning thickness is equal to a required transverse translation distance. While the arch foot separated body is being held, the sectioned concrete is removed. Then, positions of all the transverse rollers of the arch foot maintaining devices at the bottom and back of the arch foot remain unchanged. All rollers of an arch foot maintaining device at a side surface without sectioning push the arch foot separated body, and all rollers of an arch foot maintaining device at a side surface undergoing sectioning are retracted accordingly until the arch foot separated body is pushed in place. Then positioning blocks 13 ((e) of FIG. 5) are placed in a reserved rectangular groove at the pushing side to fix the arch foot separated body. Finally, rollers of all arch foot maintaining devices are lowered, and all the arch foot maintaining devices are removed, and concrete is poured into all rectangular grooves and around the arch foot separated body. It should be noted that FIG. 5 shows a case of four sectional planes. In a case of five sectional planes, operation of an arch foot maintaining device in a sectional plane at a front portion of the arch foot is identical with operation of the arch foot maintaining device at the back of the arch foot.

(2) Longitudinal Translation

After completion of providing the rectangular groove, plane sectioning, and placing the arch foot maintaining device, all longitudinal rollers ((a) of FIG. 6) of an arch foot maintaining device at the bottom of the arch foot, all rollers ((b) of FIG. 6) of an arch foot maintaining device at the back of the arch foot, and all longitudinal rollers ((c) of FIG. 6) of arch foot maintaining devices at two side surfaces of the arch foot are lifted to hold the arch foot separated body.

If the arch foot separated body needs to be moved closer to a bridge span ((d) of FIG. 6), concrete at the back of the arch foot does not need to be sectioned. Positions of all the longitudinal rollers of the arch foot maintaining devices at the bottom and two side surfaces of the arch foot remain unchanged, and all the rollers of the arch foot maintaining device at the back of the arch foot push the arch foot separated body to a specified position. Positioning blocks ((e) of FIG. 6) are placed in a reserved rectangular groove at the back of the arch foot to fix the arch foot separated body. Finally, rollers of all arch foot maintaining devices are lowered, and all the arch foot maintaining devices are removed, and concrete is poured into all rectangular grooves.

If the arch foot separated body needs to be far from the bridge span, plane sectioning ((f) of FIG. 6) is performed on the concrete at the back of the arch foot, and a sectioning thickness is equal to a required longitudinal translation distance. While the arch foot separated body is being held, the sectioned concrete is removed. Then, positions of all the longitudinal rollers of the arch foot maintaining devices at the bottom and two side surfaces of the arch foot remain unchanged, and all the rollers of the arch foot maintaining device at the back of the arch foot are gradually retracted until the arch foot separated body reaches a specified position (the roller moves with the arch foot separated body). Finally, rollers of all arch foot maintaining devices are lowered, and all the arch foot maintaining devices are removed, and concrete is poured into all rectangular grooves.

(3) Vertical Translation

After completion of providing the rectangular groove, plane sectioning, and placing the arch foot maintaining device, all rollers ((a) of FIG. 7) of an arch foot maintaining device at the bottom of the arch foot, all vertical rollers ((b) of FIG. 7) of an arch foot maintaining device at the back of the arch foot, and all vertical rollers ((c) of FIG. 7) of arch foot maintaining devices at two side surfaces of the arch foot are lifted to hold the arch foot separated body.

If the arch foot separated body needs to be translated vertically upward ((d) of FIG. 7), concrete at the bottom of the arch foot does not need to be sectioned. Positions of all the vertical rollers of the arch foot maintaining devices at the back and two side surfaces of the arch foot remain unchanged, and all the rollers of the arch foot maintaining device at the bottom of the arch foot push the arch foot separated body to a specified position. Positioning blocks ((e) of FIG. 7) are placed in a reserved rectangular groove at the bottom of the arch foot to fix the arch foot separated body. Finally, rollers of all arch foot maintaining devices are lowered, and all the arch foot maintaining devices are removed, and concrete is poured into all rectangular grooves.

If the arch foot separated body needs to be translated vertically downward, plane sectioning ((f) of FIG. 7) is performed on the concrete at the bottom of the arch foot, and a sectioning thickness is equal to a required vertical translation distance. While the arch foot separated body is being held, the sectioned concrete is removed. Then, positions of all vertical rollers of the arch foot maintaining devices at the back and two side surfaces of the arch foot remain unchanged, and all the rollers of the arch foot maintaining device at the bottom of the arch foot are gradually retracted until the arch foot separated body reaches a specified position. Finally, rollers of all arch foot maintaining devices are lowered, and all the arch foot maintaining devices are removed, and concrete is poured into all rectangular grooves.

(4) Rotation Around a Transverse Axis

After completion of providing the rectangular groove, plane sectioning, and placing the arch foot maintaining device, first, all longitudinal rollers ((a) of FIG. 8) of the arch foot maintaining device at the bottom of the arch foot, all vertical rollers ((b) of FIG. 8) of the arch foot maintaining device at the back of the arch foot, and all longitudinal rollers (or all vertical rollers or all rollers) ((c) of FIG. 8) of the arch foot maintaining devices at the two side surfaces of the arch foot are lifted to hold the arch foot separated body. Next, plane sectioning ((d) of FIG. 8) is performed on the concrete at the bottom and back of the arch foot, and a sectioning thickness matches a required angle for rotation around the transverse axis. While the arch foot separated body is being held, sectioned concrete is removed. Then, positions of all the longitudinal rollers (or all the vertical rollers or all the rollers) of the arch foot maintaining devices at the two side surfaces of the arch foot remain unchanged. All the longitudinal rollers of the arch foot maintaining device at the bottom of the arch foot and all the vertical rollers of the arch foot maintaining device at the back of the arch foot push the arch foot separated body according to a direction where the arch foot separated body is rotated or are retracted ((e) of FIG. 8) until the arch foot separated body is pushed in place. Then positioning blocks are placed in reserved rectangular grooves at the bottom and back of the arch foot to fix the arch foot separated body, and the size of the positioning block is equal to the size of a gap between a corresponding reserved rectangular groove and the arch foot separated body. Finally, rollers of all arch foot maintaining devices are lowered, and all the arch foot maintaining devices are removed, and concrete is poured into all rectangular grooves. It should be noted that no arch foot maintaining devices may be placed at the two side surfaces of the arch foot.

(5) Rotation Around a Longitudinal Axis

After completion of providing the rectangular groove, plane sectioning, and placing the arch foot maintaining device, first, all transverse rollers ((a) of FIG. 9) of the arch foot maintaining device at the bottom of the arch foot, all vertical rollers (or all transverse rollers or all rollers) ((b) of FIG. 9) of the arch foot maintaining device at the back of the arch foot, and all vertical rollers ((c) of FIG. 9) of the arch foot maintaining devices at the two side surfaces of the arch foot are lifted to hold the arch foot separated body. Next, plane sectioning ((d) of FIG. 9) is performed on the concrete at the bottom and two side surfaces of the arch foot, and a sectioning thickness matches a required angle for rotation around the longitudinal axis. While the arch foot separated body is being held, the sectioned concrete is removed. Then, positions of all the vertical rollers (or all the transverse rollers or all the rollers) of the arch foot maintaining device at the back of the arch foot remain unchanged. All the transverse rollers of the arch foot maintaining device at the bottom of the arch foot and all the vertical rollers of the arch foot maintaining devices at the two side surfaces of the arch foot push the arch foot separated body according to a direction where the arch foot separated body is rotated or are retracted ((e) of FIG. 9) until the arch foot separated body is pushed in place. Then positioning blocks are placed in reserved rectangular grooves at the bottom and two side surfaces of the arch foot to fix the arch foot separated body, and the size of the positioning block is equal to the size of a gap between a corresponding reserved rectangular groove and the arch foot separated body. Finally, rollers of all arch foot maintaining devices are lowered, and all the arch foot maintaining devices are removed, and concrete is poured into all rectangular grooves. Note that no arch foot maintaining devices may be placed at the back of the arch foot.

(6) Rotation Around a Vertical Axis

After completion of providing the rectangular groove, plane sectioning, and placing the arch foot maintaining device, first, all transverse rollers (or all longitudinal rollers or all rollers) ((a) of FIG. 10) of the arch foot maintaining device at the bottom of the arch foot, all transverse rollers ((b) of FIG. 10) of the arch foot maintaining device at the back of the arch foot, and all longitudinal rollers ((c) of FIG. 10) of the arch foot maintaining devices at the two side surfaces of the arch foot are lifted to hold the arch foot separated body. Next, plane sectioning ((d) of FIG. 10) is performed on the concrete at the back and two side surfaces of the arch foot, and a sectioning thickness matches a required angle for rotation around the vertical axis. While the arch foot separated body is being held, the sectioned concrete is removed. Then, positions of all the transverse rollers (or all the longitudinal rollers or all the rollers) of the arch foot maintaining devices at the bottom surfaces of the arch foot remain unchanged. All the transverse rollers of the arch foot maintaining device at the back of the arch foot and all the longitudinal rollers of the arch foot maintaining devices at the two side surfaces of the arch foot push the arch foot separated body according to a direction where the arch foot separated body is rotated or are retracted ((e) of FIG. 10) until the arch foot separated body is pushed in place. Then positioning blocks are placed in reserved rectangular grooves at the back of the arch foot and at the two side surfaces of the arch foot to fix the arch foot separated body, and the size of the positioning block is equal to the size of a gap between a corresponding reserved rectangular groove and the arch foot separated body. Finally, rollers of all arch foot maintaining devices are lowered, and all the arch foot maintaining devices are removed, and concrete is poured into all rectangular grooves. It should be noted that no arch foot maintaining devices may be placed at the bottom of the arch foot.

The embodiments of the present invention have been described above with reference to the accompanying drawings. The embodiments of the present invention and features of the embodiments may be combined with each other if there is no conflict. For convenience of description, the words "above", "below" and the like only indicate directions consistent with those of the accompanying drawings, and are not intended to limit the structure. The present invention is not limited to the specific embodiments described above, and the specific embodiments described above are merely exemplary and not limitative. Those of ordinary skill in the art may make various variations under the teaching of the present invention without departing from the spirit of the present invention and the protection scope of the claims, and such variations shall all fall within the protection scope of the present invention.

What is claimed is:

1. An arch foot maintaining device, comprising a plurality of supporting structures combined along a straight line, wherein the supporting structure includes a base, two base supporting seats disposed on an upper surface of the base, a hydraulic jack, a roller (3), and a roller supporting seat, the base is a cuboid with equal length and width, and a through hole running through four side surfaces of the base is provided on the base, a vertical guide groove is provided on each of the two base supporting seats, the roller supporting seat is U-shaped and located between the two base supporting seats, the roller is rotatably supported in the roller supporting seat (4), two ends of a central axis of the roller are located in the two guide grooves of the two base supporting seats, respectively, a plane where the roller lies is parallel to one of the side surfaces of the base, the hydraulic jack is disposed within the base, and a top of the hydraulic jack abuts against a bottom of the roller supporting seat.

2. The arch foot maintaining device according to claim 1, wherein the central axes of the rollers of the two adjacent supporting structures are perpendicular to each other.

3. The arch foot maintaining device according to claim 1, wherein two sides of the roller each have a shaft, and the shaft is disposed on the roller supporting seat through a bearing.

4. The arch foot maintaining device according to claim 3, wherein the central axes of the rollers of the two adjacent supporting structures are perpendicular to each other.

5. The arch foot maintaining device according to claim 1, wherein a vertical pin hole is provided on each of four corners of the base, a rectangular connecting hole is provided on side surfaces of the four corners of the base at different heights, and the rectangular connecting hole is in communication with the vertical pin hole, two adjacent supporting structures are connected through a connecting rod whose two ends are provided with a circular through hole, the two ends of the connecting rod are respectively inserted into the rectangular connecting holes of the two adjacent supporting structures, and a pin in the vertical pin hole passes through the circular through hole of the connecting rod.

6. The arch foot maintaining device according to claim 5, wherein the central axes of the rollers of the two adjacent supporting structures are perpendicular to each other.

7. A maintenance method for achieving multi-degree-of-freedom displacement of an arch foot, the arch foot maintaining device according to claim 1 being used in the method, and the method specifically comprising following steps:

1) providing rectangular grooves (10) around the arch foot, wherein the rectangular grooves are respectively distributed in at least four sectional planes of the arch foot, the sectional planes includes one plane perpendicular to a longitudinal direction of a bridge serving as a back plane, two planes perpendicular to a transverse direction of the bridge serving as side planes, and one horizontal plane, the rectangular grooves in the back plane and side planes extend along a vertical direction, and the rectangular groove in the horizontal plane extends along the longitudinal direction of the bridge;
2) performing plane sectioning along planes of the rectangular grooves close to the arch foot, and obtaining an arch foot separated body by the at least four sectional planes;
3) placing the arch foot maintaining device at every one of the rectangular grooves, and reserving one of the rectangular grooves being empty between two adjacent arch foot maintaining devices;
4) adjusting a roller position of the arch foot maintaining device, wherein the rollers of the arch foot maintaining device are adjusted according to a required arch foot displacement form, so that at least partial rollers of the arch foot maintaining device push against the corresponding sectional plane;
5) cutting off concrete located in a direction where the arch foot separated body moves, and removing the concrete that is cut off;
6) adjusting the roller position of the arch foot maintaining device again, wherein the at least partial rollers push the arch foot separated body to move or move with the arch foot separated body;
7) lowering all the rollers of the arch foot maintaining device after the arch foot separated body is moved in place, and removing the arch foot maintaining device; and
8) pouring concrete around the arch foot separated body.

8. The maintenance method according to claim 7, wherein in the step 7), after the arch foot separated body (12) is moved in place, positioning blocks (13) for positioning the arch foot separated body (12) are placed in at least a portion of the empty rectangular groove (10).

9. The maintenance method according to claim 7, wherein in the step 4), when the arch foot is adjusted for transverse translation, transverse rollers of the arch foot maintaining devices in the rectangular grooves distributed in the back plane and in the horizontal plane push against a corresponding sectional plane, and all the rollers of the arch foot maintaining devices in the rectangular groove distributed in the side planes push against a corresponding sectional plane;

when the arch foot is adjusted for longitudinal translation, longitudinal rollers of the arch foot maintaining devices in the rectangular grooves distributed in the side planes and in the horizontal plane push against a corresponding sectional plane, and all rollers of arch foot maintaining devices in the rectangular groove distributed in the back plane push against a corresponding sectional plane; and when the arch foot is adjusted for vertical translation, vertical rollers of the arch foot maintaining devices in the rectangular grooves distributed in the back plane and in the side planes push against a corresponding sectional plane, and all rollers of the arch foot maintaining devices in the rectangular groove distributed in the horizontal plane push against a corresponding sectional plane.

10. The maintenance method according to claim 7, wherein in the step 4), when the arch foot is rotated transversely, vertical rollers of the arch foot maintaining devices in the rectangular groove distributed in the back plane push against a corresponding sectional plane, and longitudinal rollers of the arch foot maintaining devices in the rectangular groove distributed in the horizontal plane push against a corresponding sectional plane;

when the arch foot is rotated longitudinally, vertical rollers of the arch foot maintaining devices in the rectangular groove distributed in the side planes push against a corresponding sectional plane, and transverse rollers of the arch foot maintaining devices in the rectangular groove distributed in the horizontal plane push against a corresponding sectional plane; and when the arch foot is rotated vertically, transverse rollers of the arch foot maintaining devices in the rectangular groove distributed in the back plane push against a corresponding sectional plane, and longitudinal rollers of the arch foot maintaining devices in the rectangular groove distributed in the side planes push against a corresponding sectional plane.

* * * * *